United States Patent [19]

Upmeier et al.

[11] Patent Number: 4,809,627

[45] Date of Patent: Mar. 7, 1989

[54] AUTOMATIC SEWING MACHINE

[75] Inventors: Egon Upmeier, Lage-Kachtenhausen; Jochen Fischer, Detmold, both of Fed. Rep. of Germany

[73] Assignee: Kochs Adler Aktiengesellschaft, Bielefeld, Fed. Rep. of Germany

[21] Appl. No.: 216,787

[22] Filed: Jul. 8, 1988

[30] Foreign Application Priority Data

Jul. 21, 1987 [DE] Fed. Rep. of Germany ..... 3724002

[51] Int. Cl.[4] ..... D05B 21/00; D05B 3/22

[52] U.S. Cl. ..... 112/121.12; 112/104; 112/113

[58] Field of Search ..... 112/121.12, 121.15, 112/104, 113, 121.11

[56] References Cited

U.S. PATENT DOCUMENTS

| | | | |
|---|---|---|---|
| 3,528,378 | 9/1970 | Westhoff et al. . | |
| 3,895,590 | 7/1975 | Perlino . | |
| 4,114,544 | 9/1975 | Miyachi et al. | 112/104 |
| 4,419,945 | 12/1983 | Nishina | 112/121.12 X |
| 4,444,135 | 4/1984 | Yanagi et al. | 112/121.12 |
| 4,446,802 | 5/1984 | Seholl | 112/121.12 |
| 4,462,320 | 7/1984 | Seholl | 112/104 |

*Primary Examiner*—H. Hampton Hunter

*Attorney, Agent, or Firm*—Laff, Whitesel, Conte & Saret

[57] ABSTRACT

An automatic sewing machine has a guiding device by means of which workpieces can be guided, on the one hand, from a taking over position to a sewing position under a sewing head and, on the other hand, under this sewing head in two coordinate directions. To enable the handling of large workpieces in the case of a particularly simple design, the whole guiding device is arranged above a workpiece receiving plate for the workpieces, a free space for large workpieces being provided on the side of the workpiece receiving plate lying opposite an operator's side.

10 Claims, 6 Drawing Sheets

AUTOMATIC SEWING MACHINE

FIELD OF THE INVENTION

The invention relates to an automatic sewing machine comprising a sewing head which has an upper arm with a needle which is movable up and down relative thereto and a base plate and which is mounted rigidly on a stand, and comprising a guiding device for workpieces which are arranged on one another and are to be sewn together, which device has a workpiece holder which is designed to feed the workpieces on a workpiece receiving plate from a taking over position some distance from the sewing head to a sewing position on the sewing head, the workpiece holder being movable in two directions perpendicular to one another relative to the sewing head in the sewing position in a sewing plane running perpendicular to the needle corresponding to the preset path of a seam.

BACKGROUND OF THE INVENTION

An automatic sewing machine of the type as defined is known from U.S. Pat. No. 3,528,378. In this machine a preparatory station in the form of a folding device is provided parallel to the main longitudinal direction of a sewing head, i.e. the sewing head is situated—as seen from the operator's side—in the rear area of the stand. With the aid of a guiding device the prepared workpieces are moved with a workpiece holder along a U-shaped path into a sewing position in which sewing takes place while the workpiece holder is moved with the workpiece in two coordinate directions. Handling of large workpieces is not provided for with this device.

It is known from U.S. Pat. No. 3,895,590 to move workpieces from a preparatory station by means of a sliding cylinder into a sewing position on the sewing head in which the sewing head and workpiece holder, together with the workpiece, are then moved in the usual manner relative to one another while a preset seam is sewn. The provision of a separate drive for the transfer of workpieces from the preparatory station to the sewing position is intended to enable the use of this automatic sewing machine for large workpieces.

The two known automatic sewing machines described above each have a workpiece receiving plate which permits overhanging, i.e. hanging down of larger workpieces, e.g. trouser sections, only towards the operator's side. Through this, rolling up of that area of the larger workpiece projecting over the smaller workpiece to be sewn on is unavoidable when sewing workpieces in which the workpiece to be sewn on, for example a pocket, is to be arranged approximately in the centre of a large workpiece. Larger workpieces of this type can be for example parts of overalls.

SUMMARY OF THE INVENTION

It is an object of the invention to develop an automataic sewing machine of the type as defined, in such a manner that with a particularly simple design the handling of large workpieces is possible.

This problem is solved in accordance with the invention by the entire guiding device being arranged above the workpiece receiving plate. By the inventive measures it is achieved that all the space above the receiving plate is freely available for the handling of the workpiece.

When the guiding device has two carriages which are movable perpendicular to one another and parallel to the sewing plane and at least one carriage of which has a path of movement which also covers the taking over position, the necessity is avoided to provide a separate drive also for the relatively long path of movement of the workpiece holder between the transfer position and sewing position. The cross carriage, which is necessary for guiding the workpieces relative to the fixed sewing head, is also used to transfer the workpiece from the transfer position to the sewing position, the arrangement of the transfer position relative to the sewing position being such that only one of the two carriages of the cross carriage must have a correspondingly long path of movement.

When the side of the workpiece receiving plate lying opposite an operator's side is immediately followed by a free space for large workpieces, which space runs essentially parallel to the path of movement between the taking over position and the sewing position and when the free space is shaped approximately like a channel, long workpieces are enable to hang down freely from the workpiece receiving plate on one side or both sides so that unhindered handling is possible. When a folding device is provided as a preparatory station and the free space also extends through the folding device, automatic feeding is enable in front of the preparatory station through which at least the lower large workpiece is displaced continuously in a straight line until the sewing position is reached.

The measures according to the invention make it particularly meaningful that the arm and the base plate are not connected to one another in the region of the workpiece receiving plate, and that the free space extends over the whole length of the automatic sewing machine. This enables conveyance of the workpiece or workpieces in a straight line out of the area before the taking over position until a position after the sewing position is reached. Such measures facilitate the complete automation of the passage of workpieces through a production line.

Further advantages and features of the invention will become apparent from the ensuing description of exemplary embodiments taken in conjunction with the drawing.

DESCRIPTION OF THE PREFERRED EMBODIMENTS

Figure 1:
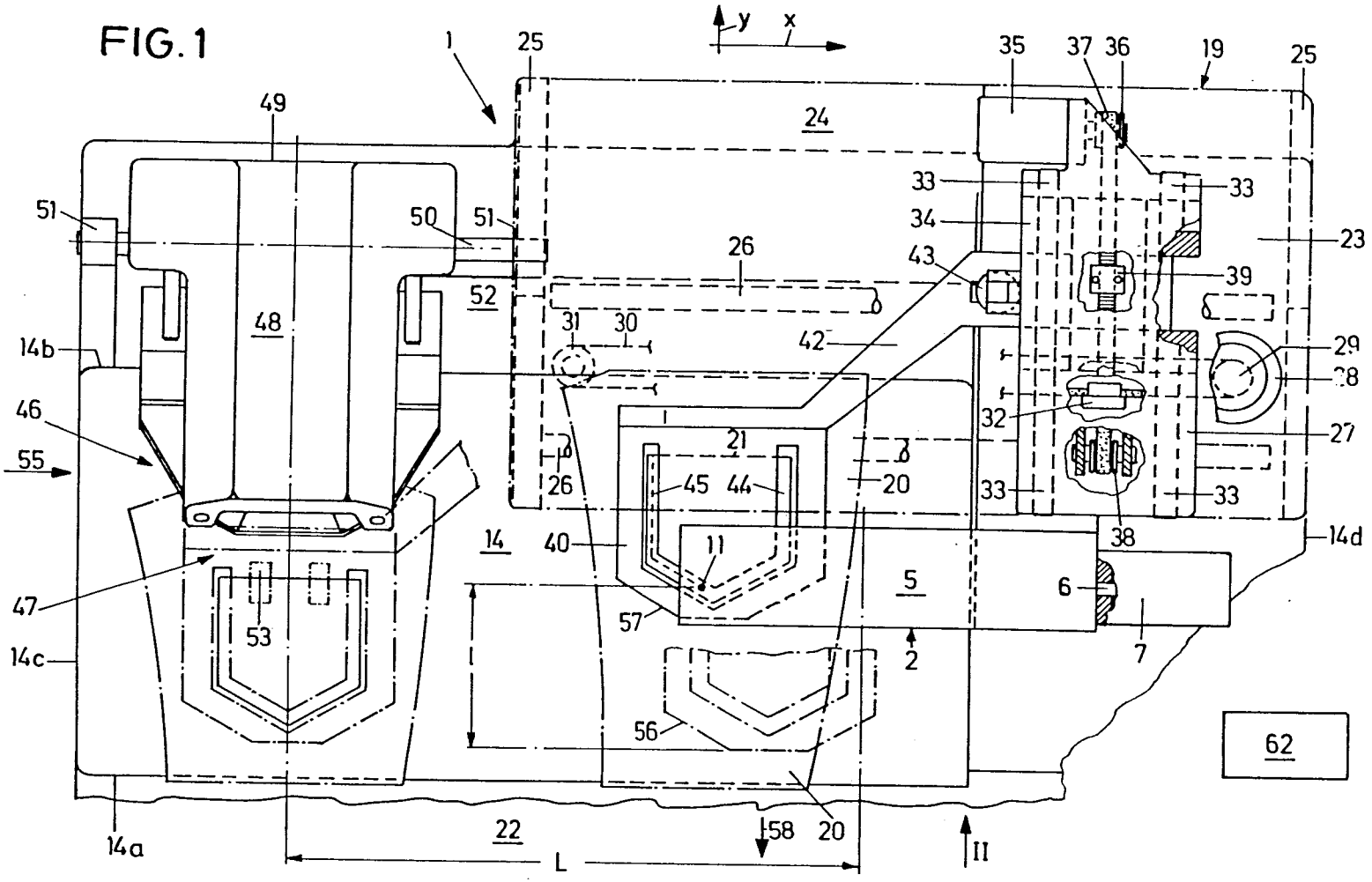
FIG. 1 shows a partially broken away plan view of an automatic sewing machine according to the invention.
Figure 2:
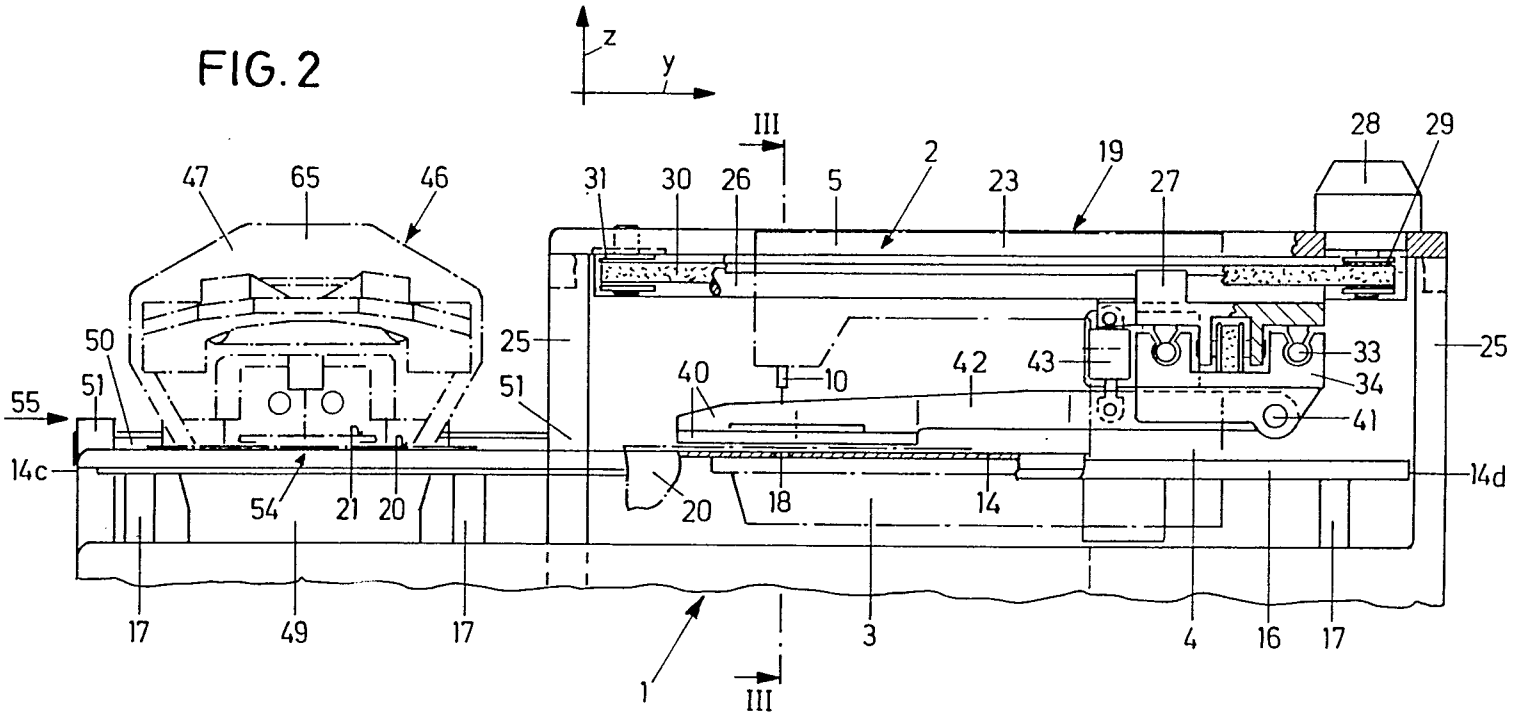
FIG. 2 shows a front view, also partially broken away, of the automatic sewing machine according to the arrow II in FIG. 1.
Figure 3:
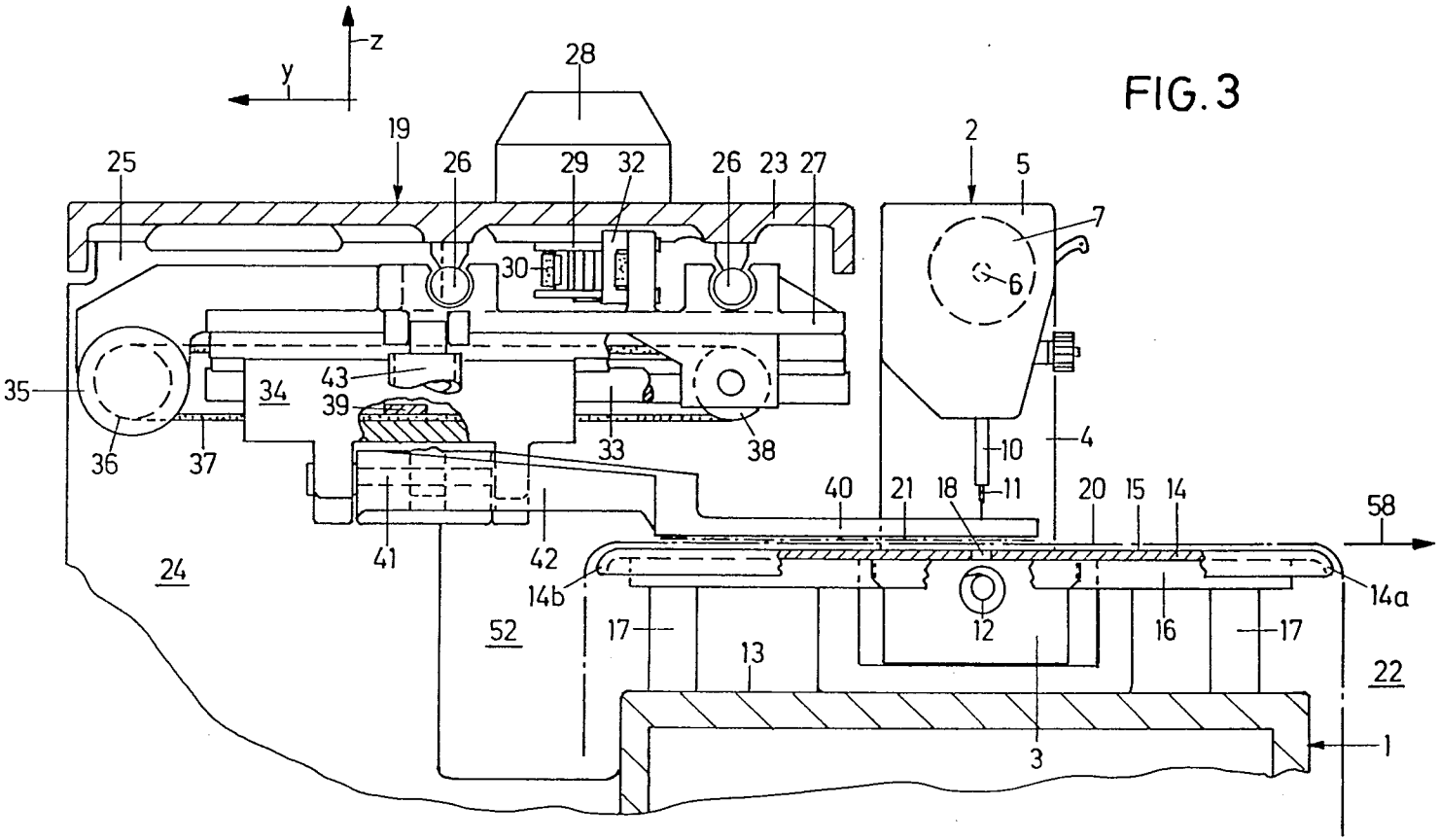
FIG. 3 shows a vertical partial section through the automatic sewing machine, along the line III—III in FIG. 2.

The automatic sewing machine shown in FIGS. 1 to 3 has a stand 1 on which a sewing head 2 is rigidly mounted. It consists in the usual manner of a base plate 3, a standard 4 and an upper arm 5. Mounted conventionally in the arm 5 of the sewing head 2 is an arm shaft 6 which can be driven by an electric sewing machine drive motor 7. The drive of a needle bar 10 with a needle 11 and, in addition, the drive of a hook 12 situated in the base plate 3 are derived in the conventional manner from the arm shaft 6.

Arranged above the upper surface 13 of the stand 1, on the latter, is a workpiece receiving plate 14, the upper side of which defines a sewing plane 15. This workpiece receiving plate 14 is supported—at least partially—on a supporting plate 16 which is supported on the stand 1 by way of supports 17. This workpiece receiving plate 14 is also supported on the base plate 3 of the sewing head 2 and has, in the path of movement of the needle bar 10 and needle 11 which is defined as the z direction, a stitch hole 18 permitting the passage of the needle 11 to the hook 12.

Above the workpiece receiving plate 14 there is provided a guiding device 19 for workpiece cuts 20, 21 which are to be sewn together. This device is—as seen from the operator's side 22—arranged behind the sewing head. It has an upper base plate 23 which is supported behind the workpiece receiving plate 14 on the stand 1 by way of vertical supporting walls 25 in the rearward area 24 of the stand 1 opposite to the operator's side 22—as seen from the operator's side 22. Attached to the underside of this base plate 23 are guide webs 26 which run parallel to one another in the x direction and on which a carriage 27 is arranged so as to be slidable in the x direction. This carriage 27 is driven by an electric motor 28, which in this case can be a geared motor, via a timing belt pulley 29 and an endless timing belt 30. The motor 28, together with the timing belt pulley 29, is supported on the base plate 23. The guide roller 31 is likewise mounted in the base plate 23. The timing belt 30, which is arranged between the guide webs 26 below the base plate 23, is connected to the carriage 27 by means of a securing device 32.

Attached to the underside of the carriage 27, which is designated as the x carriage, is a further pair of guide rods 33 which extend in the y direction, i.e. perpendicular to the x direction and parallel to one another and on which a further carriage 34 is slidably guided in the y direction. This carriage 34 is therefore designated as the y carriage. Both carriages 27, 34 are therefore guided so as to be suspended from respective guide webs 26 and guide rods 33. The drive of the y carriage is provided via an electric motor 35 which, if necessary, is likewise in the form of a geared motor and is mounted on the x carriage in the rearward area 24. It has a timing belt pulley 36 by which the y carriage is driven via an endless timing belt 37. The timing belt 37 is guided via a guide roller 38 mounted on the underside of the y carriage and is attached to the underside of the y carriage 34 by means of a securing device 39. The x direction and y direction run perpendicular to one another and to the z direction. The x, y and z directions thus form a normal cartesian coordinate system. The x and y directions run parallel to the sewing plane 15. The x direction is parallel to the main longitudinal direction of the sewing head, i.e. parallel to the arm shaft 6.

A workpiece holder 40 is mounted on the underside of the y carriage 34 about an axis of rotation 41 running parallel to the y direction. For this purpose the workpiece holder 40 is attached to the end of an angle lever 42, the other end of which is mounted on the axis of rotation 41. As shown in FIGS. 1 and 3, the angle lever 42 is bent twice, i.e. firstly away from the workpiece holder 40 in the y direction towards the rearward area 24 and, secondly, upwards in the z direction from the workpiece receiving plate 14 to the underside of the y carriage 34. Between the axis of rotation 41 and the workpiece holder 40 there is provided a lift and press drive 43 which, on the one hand, engages on the angle lever 42 and, on the other hand, engages on the y carriage 34. The drive in this case is a linear drive which is designed conventionally in the form of a pneumatically actuatable piston-cylinder drive. It follows from the preceding that the entire guiding device 19 with all the associated components is arranged above the workpiece receiving plate 14, i.e. it can be arranged very close to the sewing head 2.

The workpiece holder 40 has a slot 44 corresponding to the path of the seam 45 to be produced, with the aid of which the two workpieces cuts 20, 21 are to be sewn together.

The sewing head 2 and the guiding device 19 are associated with a preparatory station 46 in which the first workpiece cut 20 and the second workpiece cut 21 are brought into the position relative to one another which is necessary for sewing. If the second workpiece cut 21 is in this case a pocket section, it is folded in the preparatory station 46 by means of a folding device 47. Folding devices of this type are generally known and in widespread use so that a detailed description is unnecessary. By way of example, reference may be made to U.S. Ser. Nos. 07/168,224, 07/169,275, and 07/168,221.

The folding device 47 has a lid-like carrier 48 which is arranged above the workpiece receiving plate 14 and rises above this plate in the direction of the rearward area 24 of the stand 1. At its rear end the carrier 48 has a downwardly projecting lever arm 49. In the area where it merges into this lever arm 49, the carrier 48 is mounted pivotably about a tilt axis 50 which extends parallel to the x direction and which is supported in bearing arms 51 fixed to the stand. Between these bearing arms 51 and the workpiece receiving plate 14 there is formed a free space 52 in the shape of a channel which also continues into the area of the sewing head, i.e. also the supporting walls 25, that is at least the supporting wall 25 facing the preparatory station 46, do not project as far as the workpiece receiving plate 14, but leave at this point the already described free space 42 in the form of a channel which extends downwardly approximately as far as the upper surface 13 of the stand 1.

Fitted in the carrier 48 which projects freely over the workpiece receiving plate 14 are the folding tools 53 which are necessary for folding the second workpiece cut 21 and by means of which e.g. a pocket section is positioned in a folded-over state precisely on the lower first workpiece cut 20. When in this position the two workpiece cuts 20, 21 are situated in a taking over position 54.

The mode of operation is as follows:

A first workpiece cut 20 is placed under the folding device 47 on the workpiece receiving plate 14, feeding being possible in the x direction in the feed direction 55—particularly in the case of particularly large workpieces. The operator can obviously insert this workpiece cut 20 also from the operator's side 22, i.e. in the y direction, under the folding device 47. The second workpiece cut 21 is folded by means of the folding device 47 in a manner which cannot be described in the detail here, and positioned on the first workpiece cut 20. Both workpiece cuts 20, 21 are situated in the already mentioned taking over position 54. Now the workpiece holder in a waiting position 56 is moved in the x direction, that is into the taking over position 54 in the opposite direction to the feed direction 55. In the waiting position 56 and on the path from this position to the taking over position 54, the workpiece holder 40 is lifted clear of the workpiece receiving plate 14 by appropriate actuation of the lift and press drive 43. In the taking over position 54 it is lowered on to the two workpiece cuts 20, 21. The folding tools 53, which are still partly in the workpiece cuts, are pulled out. Then the two workpiece cuts 20, 21 are moved by appropriate driving of the x carriage 27 in the feeding direction 55, i.e. in the x direction towards the waiting position 56, and then, if necessary, also into a sewing position 57 under the sewing head 2 while moving the y carriage 34. The movability of the y carriage 34 in the y direction includes the maximum sewing distance in the y direction. If therefore the largest possible seam in the y direction is to be produced on the automatic sewing machine, the workpiece holder 40 in an extreme position travels through the waiting position 56 during the sewing movement. The total path of movement L of the workpiece holder 40 in the x direction by means of the x carriage 27 is essentially determined by the distance which is necessary to convey the workpiece cuts 20, 21 from the taking over position 54 as far as the sewing position 57 and, only to a small degree, by the displacements occurring during the sewing itself in the x direction.

When in the sewing position 57, the workpiece cuts 20, 21 are then sewn together during corresponding displacement of the workpiece holder 40 on the workpiece receiving plate 14 by corresponding driving of the x carriage 27 and y carriage 34, the already mentioned seam 45 being produced. The transfer of the workpiece cuts 20, 21 from the taking over position 54 into the sewing position 57 and the guiding of the workpieces during sewing take place with the workpiece holder 40 pressed against the workpiece receiving plate 14, i.e. the lift and press drive 43 is actuated in such a manner that it performs its pressing function. After the sewing operation is completed, the sewn together workpiece cuts 20, 21 are moved into the waiting position 56 by appropriate driving of the y carriage 34 in the direction of the operator's side 22. In this case the workpiece holder 40 is lifted clear of the sewn together workpiece cuts 20, 21 by appropriate actuation of the lift and press drive 43 so that the workpiece cuts can be removed in the direction of removal 58 in the direction of the operator's side 22. The total distance of movement L of the workpiece holder 40 in the y direction by means of the y carriage 34 is essentially determined by the necessary transfer distance from the sewing position 57 to the waiting position 56 in which the sewn workpiece cuts 20, 21 are removed.

During the transfer from preparatory station 46 to the sewing position 57 and during the sewing movement, large first workpiece cuts 20 can hang down freely over the edges 14*a*, 14*b* of the workpiece receiving plate 14 in the direction of the rearward area 24 and operator's side 22. The feeding of the first workpiece cut 20 can be already automated in this respect because it can be inserted freely in the feeding direction 55 under the folding device 47, i.e. into the preparatory station 46, that is from the edge 14*c*—which is on the left in the drawing—and which is arranged in front of the preparatory station 46 relative to the feeding direction 55. It follows from this illustration and description that the workpiece receiving plate 14 has the shape of an inverted U because of its freedom on the operator's side 22, on the one hand, and because of the oppositely lying free space 52.

Because the entire guiding device 19, including the carriages 27, 34 and the workpiece holder 40, is arranged with the angle lever 42 above the workpiece receiving plate 14, the movement of the workpiece cuts 20, 21 is not obstructed at any time even by the guiding device 19.

This design enables a C-shaped and L-shaped guiding of the workpiece cuts 20, 21. A C-shaped guidance of the workpiece cuts 20, 21 is provided if the workpieces are introduced into the preparatory station 46 from the operator's side 22, i.e. in the y direction, further guided from there in the feeding direction 55, i.e. in the x direction, and then fed out again in the y direction towards the operator's side 22. An L-shaped guidance occurs if the feeding into the preparatory station 46 is already being effected from the edge 14*c* of the workpiece receiving plate 14 in the feeding direction 55. The further sequence is then as described. In this case therefore only one deflection occurs.

Figure 4:
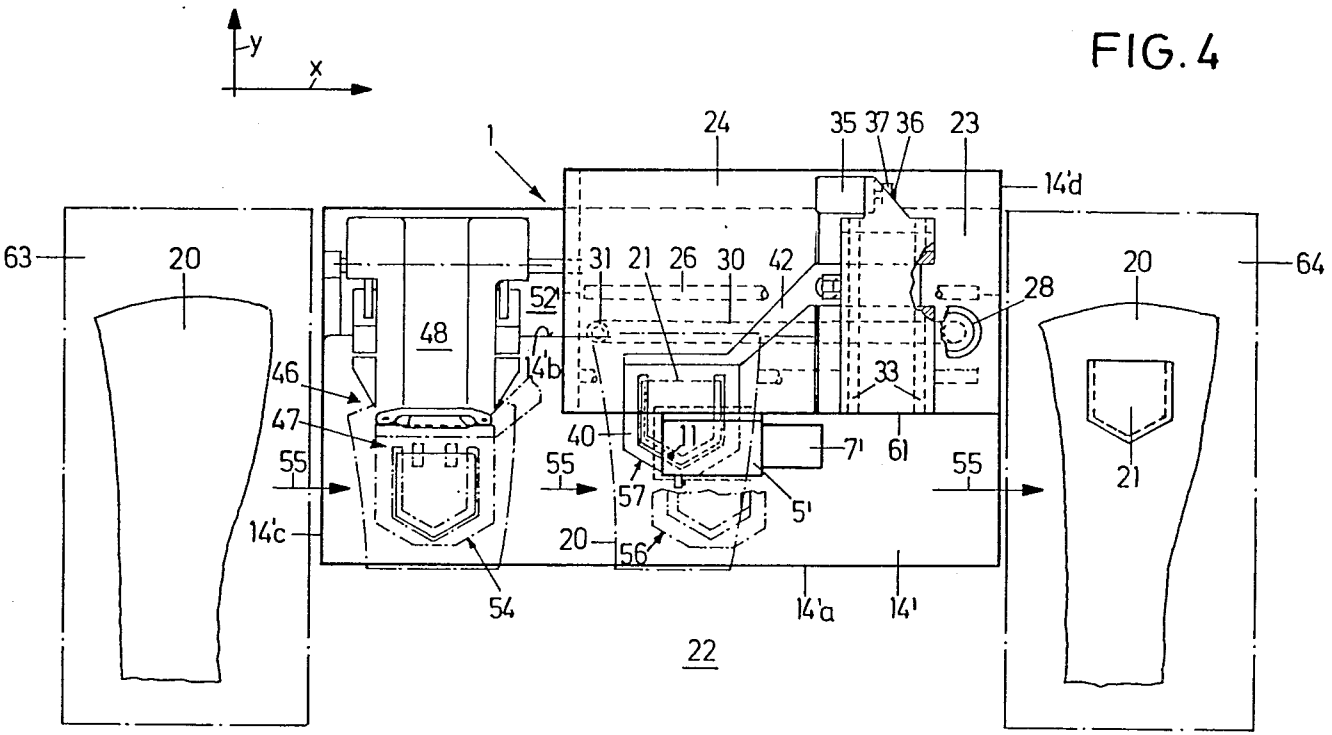
FIG. 4 shows a plan view of a modified embodiment of an automatic sewing machine according to the invention.
Figure 5:
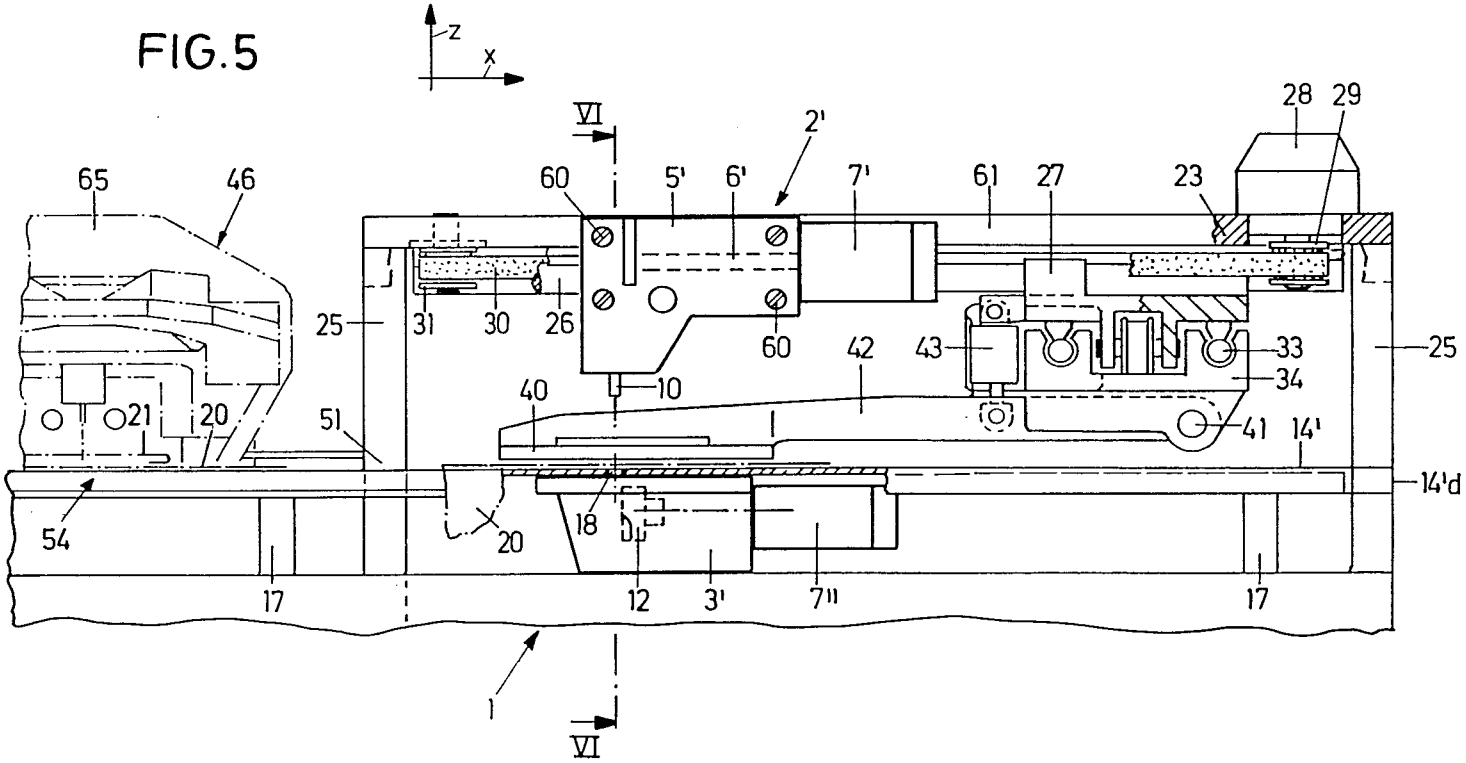
FIG. 5 shows a front view of the automatic sewing machine according to arrow V in FIG. 4.
Figure 6:
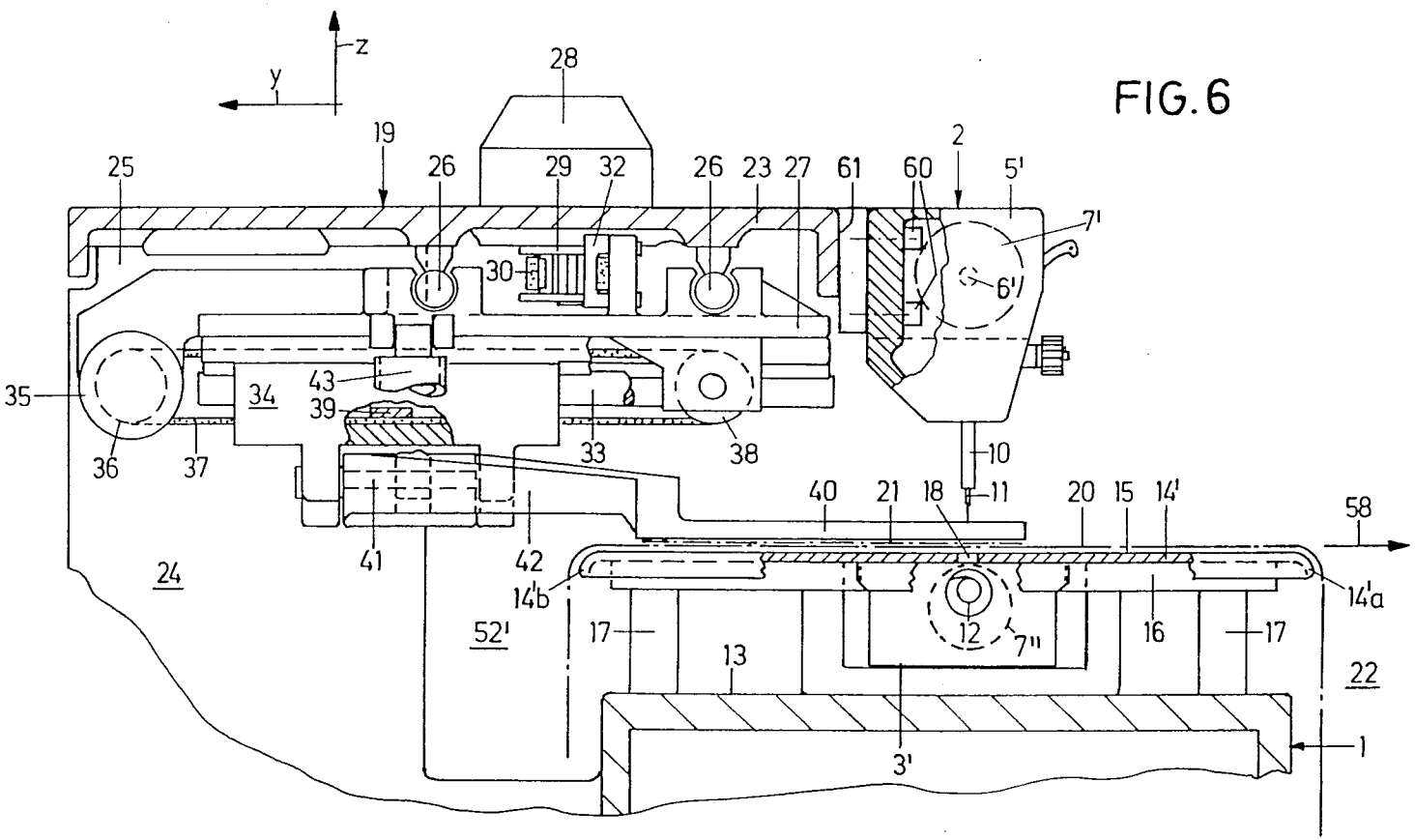
FIG. 6 shows a vertical partial section through the automatic sewing machine, along the line VI—VI in FIG. 5.

The automatic sewing machine shown in FIGS. 4 to 6 corresponds largely to the previously described automatic sewing machine according to FIGS. 1 to 3, the FIGS. 4, 5, 6 of the drawing also corresponding largely to FIGS. 1, 2, 3. A new description occurs only where there are differences between the two embodiments. Otherwise, the same reference numerals are used in FIGS. 4 to 6, as are used in FIGS. 1 to 3, the description of which is referred to in this respect.

The sewing head 3' in the embodiment according to FIGS. 4 to 6 has a two-part design, i.e. it has no standard. The upper arm 5' is screwed by means of screws 60 to a lateral edge 61 of the base plate 23 facing the operator's side 22. The arm shaft 6' is driven by a sewing machine drive motor 7'. The hook 12 in the base plate 3', which is separate from the arm 5', is driven via a second sewing machine drive motor 7''. The two motors 7' and 7'' are perfectly synchronized, i.e. they are connected to one another, for example, by way of a so-called autosyn, or they are triggered directly by a programable computer 62 which is in any case for controlling all the drives of the automatic sewing machine.

This design makes it possible for the free space 52' to be extended in the form of a channel over the entire length of the whole automatic sewing machine the x direction so that the workpieces can be introduced into the preparatory station 46 not only in the feeding direction 55 which corresponds to the x direction; they can also be conveyed further in the same direction—therefore in a straight line—after sewing and fed out over the edge 14*d* of the workpiece receiving plate 14 at the end opposite the preparatory station 46. The feeding of the workpiece cuts 20 in front of the preparatory station 46 is indicated by a table 63, whilst a table 64 for stacking the sewn together workpiece cuts 20, 21 is provided at the opposite end. In this case the feeding direction 55 corresponds throughout to the main transfer direction for the workpiece cuts 20 and, to some extent, for the workpiece cuts 21. To make this continuous transfer possible, the workpiece receiving plate 14' extends with its edges 14'*a* and 14'*b* in the x direction over the entire stand 1.

The previously described development is therefore particularly suitable for use in a sewing machine in fully automatic operation, and in this case workpiece handling devices, namely a feeding device in place of the table 63 for the two workpiece cuts 20, 21 and a stacking device in place of the table 64 for the sewn together workpiece cuts 20, 21, can then be provided on the outer edges 14'c and 14'd which define the path preset by the feeding direction 55. A particular advantage in this connection is the passage of workpieces in a straight line in the feeding direction 55 through the automatic sewing machine.

What is claimed is:

1. An automatic sewing machine comprising a sewing head (2, 2') which has an upper arm (5, 5') with a needle (11) which is movable up and down relative thereto and a base plate (3, 3') and which is mounted rigidly on a stand (1), and comprising a guiding device (19) for workpieces (20, 21) which are arranged on one another and are to be sewn together, which device has a workpiece holder (40) which is designed to feed the workpieces (20, 21) on a workpiece receiving plate (14, 14') from a taking over position (54) some distance from the sewing head (2, 2') to a sewing position (57) on the sewing head (2), the workpiece holder (40) being movable in two directions perpendicular to one another (x direction and y direction) relative to the sewing head (2, 2') in the sewing position (57) in a sewing plate (15) running perpendicular to the needle (11) corresponding to the preset path of a seam (45), wherein the entire guiding device (19) is arranged above the workpiece receiving plate (14, 14').

2. An automatic sewing machine according to claim 1, wherein the guiding device (19) has two carriages (x carriage 27 and y carriage 34) which are movable perpendicular to one another and parallel to the sewing plane (15) and at least one carriage (x carriage 27) of which has a path of movement which also covers the taking over position (54).

3. An automatic sewing machine according to claim 1, wherein the side of the workpiece receiving plate (14, 14') lying opposite an operator's side (22) is immediately followed by free space (52, 52') for large workpieces (20), which space runs essentially parallel to the path of movement between the taking over position (54) and the sewing position (57).

4. An automatic sewing machine according to claim 3, wherein the free space (52, 52') is shaped approximately like a channel.

5. An automatic sewing machine according to claim 3, wherein a folding device (47) is provided as a preparatory station (46), and the free space (52, 52') also extends through the folding device (47).

6. An automatic sewing machine according to claim 1, wherein the arm (5') and the base plate (3') are not connected to one another in the region of the workpiece receiving plate (14'), and wherein the free space (52') extends over the whole length of the automatic sewing machine.

7. An automatic sewing machine according to claim 2, wherein the carriage (x carriage 27 and y carriage 34) are in a suspended arrangement on a base plate (23) situated above the workpiece receiving plate (14').

8. An automatic sewing machine according to claim 1, wherein the taking over position (54) and the sewing position (57) lie approximately in the direction of a main longitudinal direction (x direction) of the sewing head (2, 2'), and that the guiding device (19) is arranged transversely thereto next to the sewing head (2, 2').

9. An automatic sewing machine according to claim 1, wherein the workpiece receiving plate (14, 14') extends in an essentially straight line on the operator's side (22).

10. An automatic sewing machine according to claim 4, wherein the workpiece receiving plate (14, 14') is shaped approximately like an inverted U.

* * * * *